US007144151B2

(12) United States Patent
Saaski et al.

(10) Patent No.: US 7,144,151 B2
(45) Date of Patent: Dec. 5, 2006

(54) ELECTRONIC WRIST DEVICE

(75) Inventors: Jarmo Saaski, Kempele (FI); Tero Mattinen, Kempele (FI)

(73) Assignee: Polar Electro Oy, Kempele (FI)

( * ) Notice: Subject to any disclaimer, the term of this patent is extended or adjusted under 35 U.S.C. 154(b) by 299 days.

(21) Appl. No.: 10/809,820

(22) Filed: Mar. 25, 2004

(65) Prior Publication Data

US 2005/0111307 A1 May 26, 2005

(30) Foreign Application Priority Data

Nov. 20, 2003 (FI) ..... 20031690

(51) Int. Cl.
*G04B 37/00* (2006.01)

(52) U.S. Cl. ..... 368/283; 368/294

(58) Field of Classification Search ..... 368/281, 368/283, 294–296, 300
See application file for complete search history.

(56) References Cited

U.S. PATENT DOCUMENTS

| | | | | |
|---|---|---|---|---|
| 3,386,239 | A * | 6/1968 | Shiffman | 368/296 |
| 3,640,065 | A | 2/1972 | Lederrey et al. | |
| 3,756,017 | A | 9/1973 | Genta | |
| 4,059,957 | A | 11/1977 | Monnet | |
| 4,322,834 | A | 3/1982 | Schaeren et al. | |
| 4,924,453 | A | 5/1990 | Ray et al. | |
| 6,540,396 | B1 * | 4/2003 | Barras | 368/281 |
| 6,568,573 | B1 | 5/2003 | Manigley et al. | |
| 2002/0021624 | A1 * | 2/2002 | Hiranuma et al. | 368/282 |
| 2002/0080688 | A1 | 6/2002 | Hiranuma et al. | |

FOREIGN PATENT DOCUMENTS

| | | |
|---|---|---|
| CH | 667966 | 11/1988 |
| EP | 1318437 | 6/2003 |
| JP | 6094848 | 4/1994 |
| JP | 6201848 | 7/1994 |
| JP | 08-094777 | 4/1996 |
| JP | 2000065959 | 3/2000 |

* cited by examiner

*Primary Examiner*—Kammie Cuneo
*Assistant Examiner*—Jeanne-Marguerite Goodwin
(74) *Attorney, Agent, or Firm*—Hoffmann & Baron, LLP

(57) ABSTRACT

The invention relates to a wrist device, particularly to a fastening mechanism of a cover part and a plastic body part of the wrist device. The fastening mechanism comprises a fastening structure, which in turn comprises a projecting grip structure extending at least partly into the body part, setting against a positioning surface of the body part, and blocked in relation to the mounting direction of the cover part to prevent the fastening structure from moving in a direction opposite to the mounting direction once the fastening structure has been pressed into the body part.

14 Claims, 3 Drawing Sheets

ELECTRONIC WRIST DEVICE

CROSS-REFERENCE TO RELATED APPLICATION

This application claims priority based on Finnish Patent Application No. 20031690, filed on Nov. 20, 2003.

FIELD OF THE INVENTION

The field of application of the invention comprises electronic wrist devices, such as wrist parts of heart rate monitors, watches, wrist computers, and the like.

BRIEF DESCRIPTION OF THE RELATED ART

Important characteristics of wrist devices include low weight and low production costs, which are achieved by using plastic structures, such as a plastic body or plastic body components, in the device. A wrist device typically comprises a body part with an apertured equipment compartment for installing the electronics of the device. The equipment compartment is closed with a cover part by using an interference fit so that the cover part is pressed firmly inside the edges of the body part aperture. The use of the interference fit is based on the press force between the body part and the cover part, which increases the friction between the body part and the cover part so that the parts stay in the install configuration.

Since the elasticity of a plastic structure is finite, the interference fit poses a problem due to the deforming effect of the press force on the elastic plastic structure. The joint between the plastic body and the cover part may therefore weaken over time allowing impurities, such as water and dust, to get into the equipment compartment. This may impair the operational reliability of the wrist device and shorten its service life.

SUMMARY OF THE INVENTION

It is an object of the invention to provide a wrist device such that a reliable fastening mechanism is achieved for joining the cover part of the device to the body part. This is achieved with an electronic wrist device, comprising: a plastic body part with an aperture into an equipment compartment; and a cover part joined to the body part for at least partly closing the aperture. The body part further comprises a positioning surface for positioning the cover part in relation to the body part; the wrist device comprises a fastening structure, which is at least partly pressed into the body part and which at least partly sets against the positioning surface, for joining the cover part to the body part, the fastening structure comprising cover press means for pressing the cover part into contact with the body part; and the fastening structure further comprising a projecting grip structure extending at least partly into the body part, setting against the positioning surface, and blocked in relation to the mounting direction of the cover part for preventing the fastening structure from moving in a direction opposite to the mounting direction once the fastening structure has been pressed into the body part.

Preferred embodiments of the invention are disclosed in the dependent claims.

The basic idea of the invention is that by providing a fastening structure the movement of which is blocked in the mounting direction of the cover part, a joint between the plastic body and the cover portion is achieved such that its deforming effect on the plastic body is small.

The wrist device of the invention provides a number of advantages. Small deforming effect on the plastic body reduces changes taking place in the shape of the plastic body and in the dimensions of the positioning structures, whereby the joint between the cover part and the body part remains as installed. This allows the equipment compartment to be made tight, and the amount of impurities that can get into the equipment compartment to impair the function of the electronics is kept low.

BRIEF DESCRIPTIONS OF THE DRAWINGS

In the following the invention is described in greater detail in connection with the preferred embodiments and with reference to the enclosed drawings, in which FIG. 1 illustrates an example of a cross-section of a wrist device;

DESCRIPTION OF THE PREFERRED EMBODIMENTS

Figure 1:
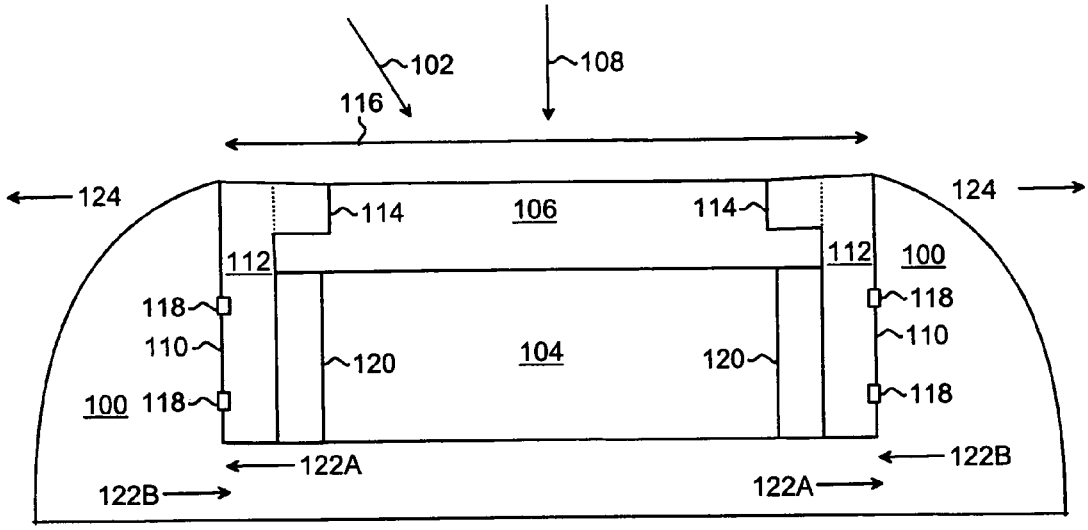
Figure 2:
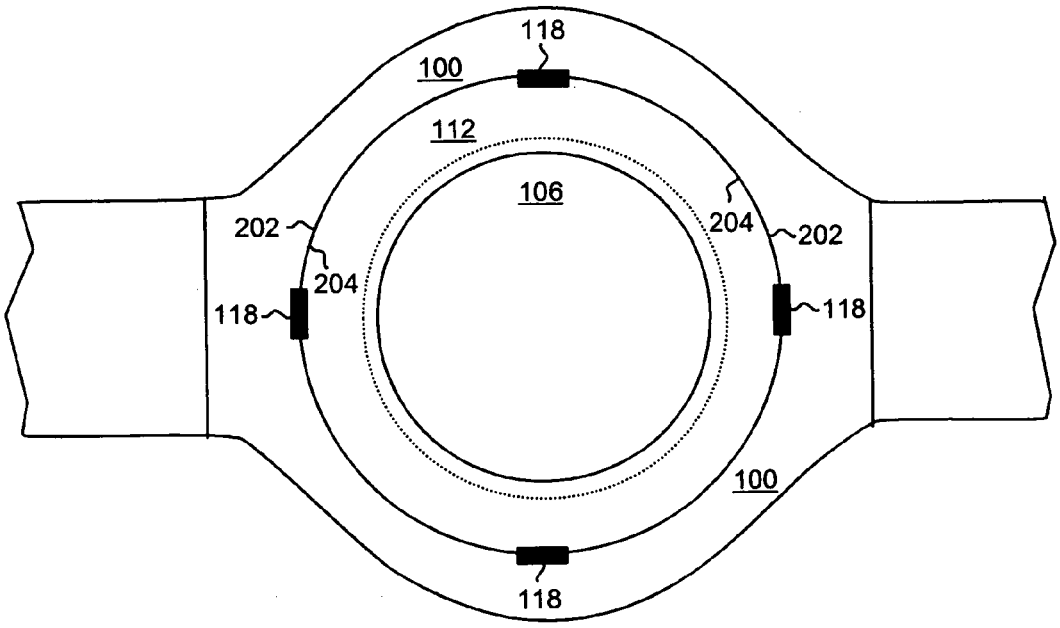
FIG. 2 illustrates an example of the wrist device as seen from the cover part side.

With reference to FIGS. 1 and 2, the structure of a wrist device will be examined. FIG. 1 illustrates an example of a cross-section of the wrist device and FIG. 2 an example of the wrist device as seen from the direction of a cover part 106.

The wrist device comprises a plastic body part 100, which in turn comprises an equipment compartment 104. The body part 100 has an aperture 102 providing access to the equipment compartment 104 when the cover part 106 is uninstalled. The aperture 102 may be similar to the equipment compartment 104 in shape and dimensions 116, although the solution disclosed here is not in any way restricted to a specific shape or dimension 116 of the aperture 102. The body part 100 may also comprise other apertures that can be closed with a fastening structure conforming to the disclosed solution or with some other fastening structure.

The material of the body part 100 may be glass fibre reinforced plastic, for example.

The plastic body part 100 may form the outer shell of the wrist device, or part of its outer shell. According to an embodiment the plastic body part 100 constitutes a part of the interior of the wrist device, the plastic body part 100 being thus used to form the equipment compartment 104. In that case the wrist device may comprise structures external to the body part, but these are not relevant to the disclosed solution.

The equipment compartment 104 is a space at least partly enclosed by the body part 100 and it may accommodate the electronics of the wrist device, for example. The contents of the equipment compartment 104 are not, however, relevant to the disclosed solution.

FIG. 1 further shows a cover part 106 joined to the body part 100 for at least partly closing the aperture 102. According to an embodiment the material of the cover part 106 is glass, the cover part 106 thus functioning similarly as a watch glass, allowing display devices, such as an LCD display (Liquid Crystal Display), placed in the equipment compartment 104 to be viewed from outside the wrist device. The material of the cover part 106 may be mineral glass, for example, or transparent plastic, such as acryl or polycarbonate. The cover part 106 is joined to the body part 104 by applying a force to the cover part 106 or to structures supporting the cover part 106 in a mounting direction 108. The mounting direction 108 may be determined by the structure of the body part 100, for example, which may cause a force that pushes the cover part 106 away from the body part 100. The push force may be caused for example by the contact between the cover part 106 and the body part 104 and/or by a material, such as sealing structures, used between the cover part 106 and the body part 104, and/or by the friction created by the mounting of the cover part 106. The mounting direction 108 is in this case preferably selected such that the force acting on the cover part 106 or on any structure supporting the cover part 106 is as uniform as possible.

The body part 100 comprises a positioning surface 110 for positioning the cover part 106 in relation to the body part 100. According to an embodiment the positioning surface 110 is parallel with the mounting direction 108 of the cover part 106.

The wrist device further comprises a fastening structure 112 which is at least partly pressed into the body part 100 and which at least partly sets against the positioning surface 110 for joining the cover part 106 to the body part 100, the fastening structure 112 comprising cover press means 114 for pressing the cover part 106 into contact with the body part 100. The material of the fastening structure 112 may be metal or plastic, for example. According to an embodiment the material of the fastening structure 112 is stainless steel.

In the cross-section shown in FIG. 1 the fastening structure 112 presses the cover part 106 on opposite sides thereof and the fastening structure 112 sets against the positioning surface 110 that is inside the body part 100. The fastening structure 112 may rest against the positioning surface 110 as a result of the rigid structure of the fastening structure 112 and/or a radial support force exerted on the fastening structure 112 by the cover part 106.

The cover press means 114 is typically a projection extending from the fastening structure 112 to the centre part of the cover part 106 and supporting the cover part 106 in the mounting direction 108 thereof. The cover press means 114 may be a part of the fastening structure 112, in which case the cover press means 114 may be defined as the part of the fastening structure 114 supporting the cover part 106 in the mounting direction thereof. In the example shown in FIG. 1 the cover press means 114 are separated from the fastening structure 112 with a broken line. On the side of the body part 100 the cover part 106 may be supported by support members 120 integrated into the body part 100 or separate from it. According to an embodiment the material of the cover press means 114 is stainless steel.

The cover part 106 may be provided with fittings for the cover press means 114, in which case the shape of the cover part 106 may at least partly follow the shape of the cover press means 114. This allows a uniform load acting on the cover part 106 to be achieved.

The fastening structure 112 further comprises a projecting grip structure 118 at least partly extending into the body part 100, setting against the positioning surface 110, and blocked in relation to the mounting direction 108 of the cover part 106 to prevent the fastening structure 112 from moving in a direction opposite to the mounting direction 108 once the fastening structure 112 has been pressed into the body part 100.

The fastening structure 112 may comprise a plural number of projecting grip structures 118, which may be side by side or in layers in the mounting direction 108. The number of the projecting grip structures 118 may be determined for example on the basis of the strength required for the joint between the cover part 106 and the body part 100, the bond strength provided by each projecting grip structure 118, the material of the projecting grip structure 118, and the material of the body part 100.

By extending the projecting grip structure 118 into the body part 100 it is possible to reduce a force 122A, 122B acting between the fastening part 112 and the body part 100, whereby the body part 100 is subjected to a minor deforming stress 124. The projecting grip structure 118 may extend into the body part 100 by 0.02–0.1 m, for example. According to an embodiment the projecting grip structure 118 extends into the body part 100 by 0.05 mm. However, the disclosed solution is not restricted to these dimensions.

The term "blocked" used in this context in connection with the projecting grip structure 118 means that when the body part 100 and the fastening structure 112 are only subjected to forces caused by the pressing of the fastening part 112 into the body part 100, the fastening between projecting grip structure 118 and the body part 100 is tighter in the direction opposite to the mounting direction 108 than in the mounting direction 108. In other words, forces caused for example by the fastening part 112 or the cover part 106 setting against some other structure than the positioning structure 110 are not taken into account. This means that a greater force is needed for drawing the fastening structure 112 away from contact with the body structure 100 than for pressing the fastening structure 112 into the body structure 100. According to an embodiment the projecting grip structure 118 bites into the body part 100, whereby a fitting is formed in the body part 100 for the projecting grip structure 118 once the fastening structure 112 has been pressed into the body part 100. In that case it may be advantageous that the material of the projecting grip structure 118 is harder than the material of the body part 100, because then the projecting grip structure 118 preserves its shape when the body part 100 and the fastening structure 112 are joined together.

According to another embodiment the body part 100 comprises fittings for the projecting grip structure 118. The fittings may include for example a slot of the same shape as the projecting grip structure 118. According to an embodiment the body part 100 comprises a partial fitting, and the projecting grip structure 118 then forms an additional fitting as it bites into the body part 100.

According to an embodiment the projecting grip structure 118 is made of a different material than the fastening structure 112. In that case the fastening structure 112 may be plastic and the projecting grip structure 118 may be metal, for example.

According to another embodiment the fastening structure 112 and the projecting grip structure are made of metal, such as stainless steel. In that case the projecting grip structure 118 and the fastening structure 112 may form a single piece.

With reference to the example of FIG. 2, in one embodiment the body part 100 comprises an inner circumference 202 which at least partly defines the border of the aperture 102 and forms at least part of the positioning surface 110, and the fastening structure 112 comprises an outer circumference 204 setting at least partly against the inner circumference 202 of the body part 100. The area of the fastening structure 112 defined by the broken line represents the fastening structure 112 area that forms the cover press means 114. The projecting grip structure 118 may be symmetrically distributed on the interface between the inner circumference 202 and the outer circumference 204. According to an embodiment the fastening structure 118 is spread on the entire circumference.

The shape of the inner circumference 202 and the outer circumference 204 may be a circle, an ellipse, or a square with rounded sides. However, the disclosed solution is not in any way restricted to a specific shape of the inner circumference 202 or the outer circumference 204.

According to an embodiment, when seen from the mounting direction 108, the fastening structure 112 is a cylindrical structure at least partly inserted into the body part 100, at least part of the cover part 106 being set on its inner circumference, supported by the cover press means 114, and the projecting grip structures 118 being arranged on the surface of its cylindrical structure. The fastening structure 112 is in this case a sleeve-type structure, and its outer surface sets against the inner circumference 202 of the body part, forming at least part of the positioning surface 110. The cover press means 114 may be formed of sleeve edges turned inwards at one end of the sleeve. Projecting grip structures 118 may be provided in layers and/or side by side on the sleeve surface at the positioning surface 110.

Figure 3:
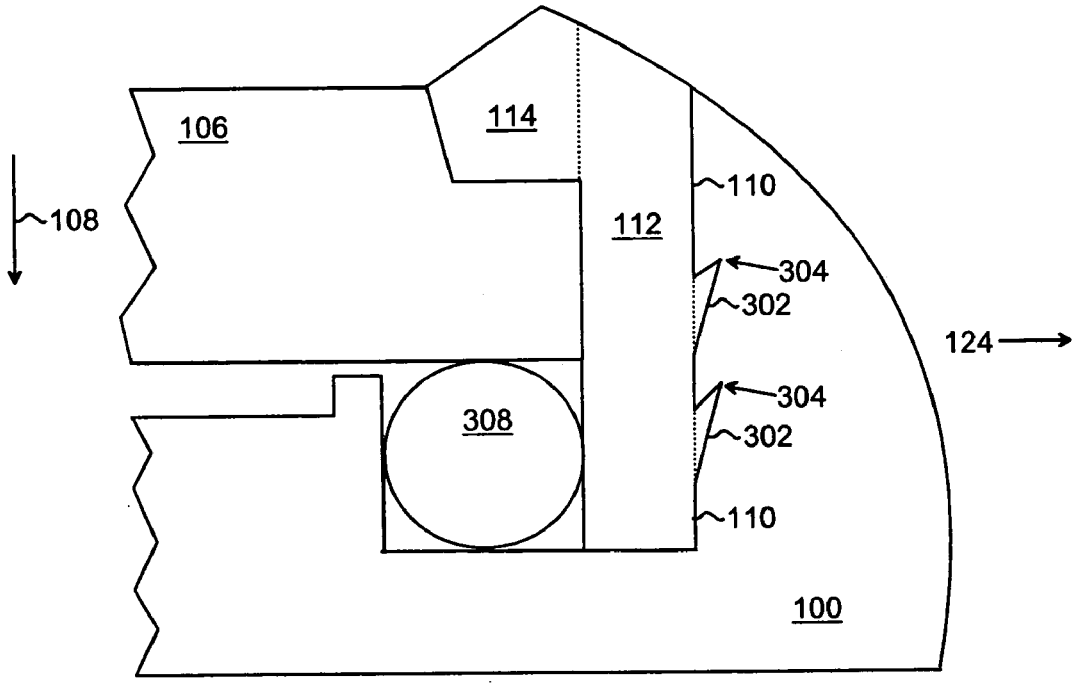
FIG. 3 illustrates a second example of a cross-section of the wrist device.

With reference to FIG. 3, an example of a partial cross-section of the wrist device will be examined. FIG. 3 shows a cross-section of the sealing means 308 between the cover part 106 and the body part 100, the press force of the sealing means 308 being parallel with the mounting direction 108. The sealing means 308 may be an O-ring made of plastic or rubber, for example.

FIG. 3 illustrates an example of a wedge-like projecting grip structure 302 with a tip that is parallel to the mounting direction 108 and a base that is opposite to the mounting direction 108. This enables the forward movement of the projecting grip structure 302 in the mounting direction 108, whereas in the opposite direction its movement is blocked; the fastening structure can thus be pressed into the body part 100 such that the stress acting on the body part during the mounting does not damage the body part 100.

According to an embodiment the projecting grip structure 302 comprises a blade part 304 placed in a direction opposite to the mounting direction 108 and pointing at least partly towards the body part 100, the blade part 304 extending at least partly into the body part 100 against the positioning surface 110, thereby reducing the force component 124 deforming the body part 100 once the fastening structure 112 has been pressed into the body part 100. The blade part 304 bites into the body part 100 when the fastening structure 112 has slightly returned in the direction opposite to the mounting direction 108 by impact of the returning force caused by the sealing means 308, for example. The material of the body part 100 between the blade part 304 and the fastening structure 112 anchors the fastening structure 112 firmly to the body part 100, whereby a force that pulls them together is created between the fastening structure 112 and the body part 100. This reduces the deforming force 124 acting on the plastic body part 100, and thus the body part 100 preserves its original shape. The blade part 304 may be sharpened, in which case the projecting grip structure 302 bites automatically into the material of the body part 100 during the return phase.

Figure 4:
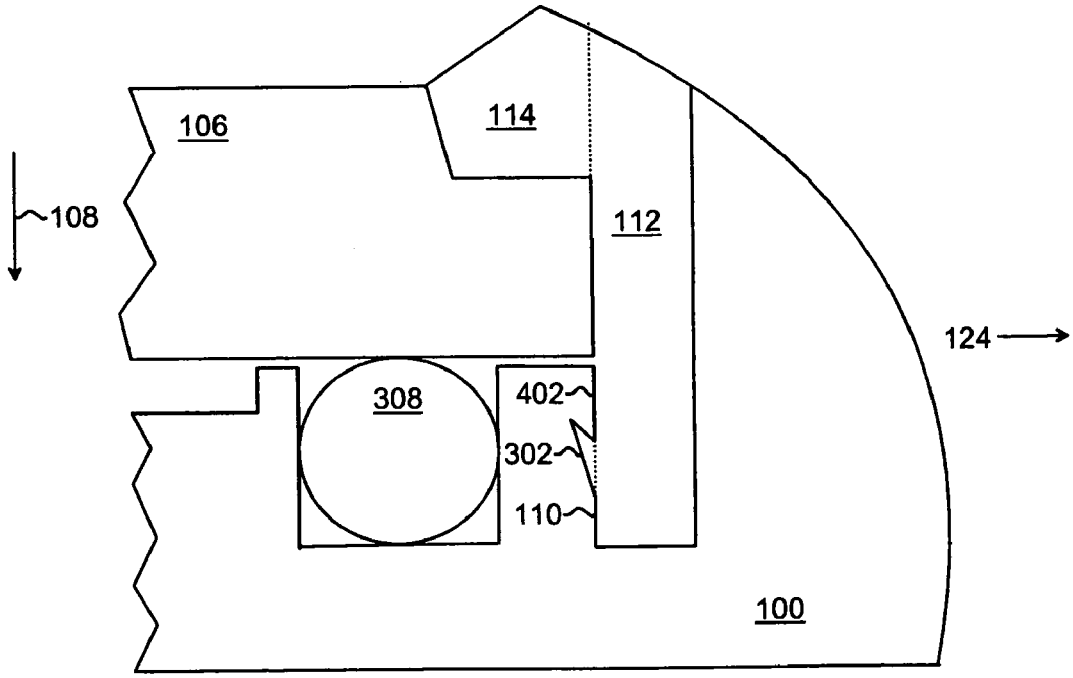
FIG. 4 illustrates a third example of a cross-section of the wrist device.

FIG. 4 illustrates an embodiment in which the body part 100 comprises an outer circumference 402 inside the body part 100, the outer circumference forming at least part of the positioning surface 110, and the fastening structure 112 comprises an inner circumference 404, which at least partly sets against the outer circumference 402 inside the body portion 100. In this embodiment the fastening structure 112 surrounds at least partly the positioning surface 110.

Figure 5:
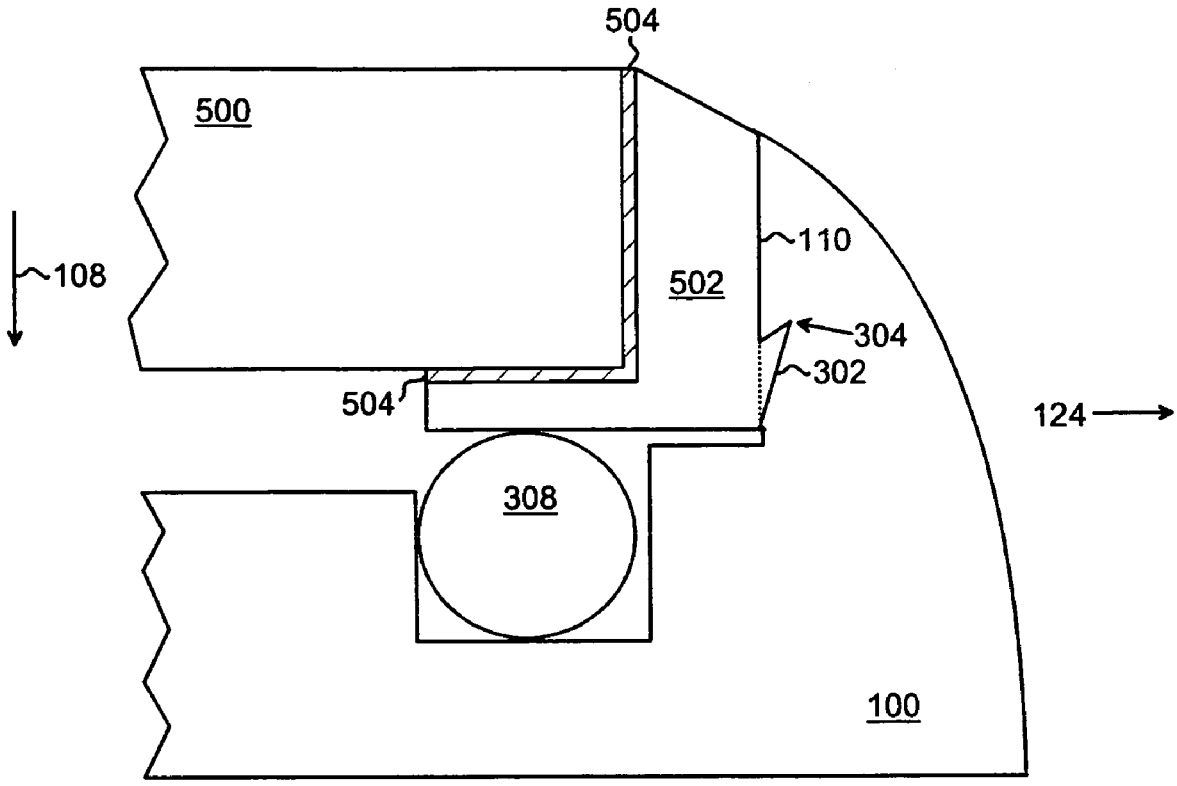
FIG. 5 illustrates a fourth example of a cross-section of the wrist device.

FIG. 5 illustrates an embodiment in which the cover press means are formed of an adhesive layer 504 provided between a cover part 500 and a fastening structure 502. In this embodiment the fastening structure 502 may also extend underneath the cover part 500, this solution allowing the fastening surface of the cover part 500, the adhesive layer 504, and the fastening structure 502 to be increased. In that case the fastening structure 502 may set against the sealing means 308. In the disclosed embodiment the fastening structure 502 may be made of stainless steel. The adhesive may be epoxy glue or silicone-based glue, for example, and the material of the cover part 500 may be plastic or glass.

Although the invention is described above with reference to an example illustrated in the accompanying drawings, it is obvious that the invention is not restricted thereto but can be varied in many ways within the scope of the attached claims.

What is claimed is:

1. An electronic wrist device, comprising:

a plastic body part with an aperture into an equipment compartment; and a cover part joined to the body part adapted to at least partly close the aperture, wherein the body part further comprises a positioning surface for positioning the cover part in relation to the body part, wherein the wrist device comprises a fastening structure, which is at least partly pressed into the body part and which at least partly sets against the positioning surface, for joining the cover part to the body part, the fastening structure comprising cover press means for pressing the cover part into contact with the body part, and wherein the fastening structure further comprises a projecting grip structure extending at least partly into the body part, setting against the positioning surface, and blocked in relation to the mounting direction of the cover part for preventing the fastening structure from moving in a direction opposite to the mounting direction once the fastening structure has been pressed within the body part in the mounting direction.

2. A wrist device according to claim 1, wherein the forward movement of the projecting grip structure is enabled in the mounting direction of the cover part.

3. A wrist device according to claim 1, wherein the positioning surface is parallel with the mounting direction of the cover part.

4. A wrist device according to claim 1, wherein the body part comprises an inner circumference defining at least partly the border of the aperture and forming at least part of the positioning surface; and wherein the fastening structure comprises an outer circumference setting at least partly against the inner circumference of the body part.

5. A wrist device according to claim 1, wherein the body part comprises an outer circumference inside the body part, which outer circumference forms at least part of the positioning surface; and wherein the fastening structure comprises an inner circumference setting at least partly against the outer circumference inside the body part.

6. A wrist device according to claim 1, wherein the projecting grip structure comprises a blade part extending in a direction opposite to the mounting direction and pointing at least partly towards the body part, the blade part extending at least partly into the body part against the positioning surface, thereby reducing a force component deforming the body part once the fastening structure has been pressed into the body part.

7. A wrist device according to claim 1, wherein the projecting grip structure is a wedge-shaped structure with a tip that is parallel with the mounting direction and a base that is opposite to the mounting direction.

8. A wrist device according to claim 1, wherein the material of the projecting grip structure is harder than the material of the body part.

9. A wrist device according to claim 1, wherein the material of the cover part is glass.

10. A wrist device according to claim 1, wherein the fastening structure, when seen in the mounting direction, is a cylindrical structure pressed at least partly into the body part, at least part of the cover part being supported against its inner circumference by the cover press means, and the projecting grip structures being arranged on the surface of its cylindrical structure.

11. A wrist device according to claim 1, wherein the body part comprises fittings for the projecting grip structure.

12. A wrist device according to claim 1, wherein the wrist device further comprises sealing means between the cover part and the body part, the press force of the sealing means being parallel with the mounting direction.

13. A wrist device according to claim 1, wherein the material of the fastening structure is stainless steel.

14. An electronic wrist device, comprising:

a plastic body part with an aperture into an equipment compartment; and a cover part joined to the body part adapted to at least partly close the aperture, wherein the body part further comprises a positioning surface adapted to position the cover part in relation to the body part, wherein the wrist device comprises a fastening structure, which is at least partly pressed into the body part and which at least partly sets against the positioning surface, for joining the cover part to the body part, the fastening structure comprising cover press means for pressing the cover part into contact with the body part, and wherein the fastening structure further comprises a projecting grip structure extending at least partly into the body part, setting against the positioning surface, and blocked in relation to the mounting direction of the cover part to prevent the fastening structure from moving in a direction opposite to the mounting direction once the fastening structure has been pressed without rotation within the body part.

* * * * *